United States Patent [19]

Ono

[11] Patent Number: 4,834,634

[45] Date of Patent: May 30, 1989

[54] SLIDING-VANE ROTARY COMPRESSOR FOR BEARING LUBRICATION

[75] Inventor: Mitsuya Ono, Konan, Japan

[73] Assignee: Diesel Kiki Co., Ltd., Tokyo, Japan

[21] Appl. No.: 209,643

[22] Filed: Jun. 21, 1988

[30] Foreign Application Priority Data

Jun. 24, 1987 [JP] Japan ..... 62-157393

[51] Int. Cl.[4] ..... F04C 29/02

[52] U.S. Cl. ..... 418/94; 418/98; 418/100; 418/104

[58] Field of Search ..... 418/94, 98, 100, 102, 418/104

[56] References Cited

U.S. PATENT DOCUMENTS 3,899,271 8/1975 Glanvall ..... 418/100
4,743,183 5/1988 Irie et al. ..... 418/94
4,743,184 5/1988 Sumikawa et al. ..... 418/104
4,770,616 9/1988 Kahrs ..... 418/102

FOREIGN PATENT DOCUMENTS 15784 1/1983 Japan ..... 418/100
24967 9/1931 Netherlands ..... 418/98

*Primary Examiner*—John J. Vrablik
*Assistant Examiner*—Timothy S. Thorpe
*Attorney, Agent, or Firm*—Wenderoth, Lind & Ponack

[57] ABSTRACT

A sliding-vane rotary compressor includes a suction hole defined in a side block for connecting compression chambers with a bearing/shaft-seal chamber, and a guide hole defined in a drive shaft for connecting the bearing/shaft-seal chamber and a low pressure chamber, whereby a bearing and a shaft seal jointly defining therebetween the bearing/shaft-seal chamber can be lubricated sufficiently by a refrigerant carrier entraining a lubricating oil.

3 Claims, 3 Drawing Sheets

SLIDING-VANE ROTARY COMPRESSOR FOR BEARING LUBRICATION

BACKGROUND OF THE INVENTION

1. Field of the Invention

The present invention relates generally to sliding-vane rotary compressors for compressing gaseous or liquid compressible mediums, and more particularly to a sliding-vane rotary compressor for use in an automobile air conditioner for compressing a refrigerant carrier.

2. Prior Art

Sliding-vane rotary compressors of this type include a circular rotor rotatably received in an elliptical bore in a cylinder and carrying thereon a plurality of radially movable vanes held in sliding contact with the inner peripheral surface of the cylinder. The rotor is fixedly mounted on a drive shaft rotatably supported by a pair of bearings mounted, respectively, in a front side block and a rear side block. Since the bearings need lubricating, a refrigerant carrier entraining a lubricating oil must be supplied to the bearings. The refrigerant carrier supplied to the bearings is prevented by a shaft seal from leaking to the outside of the compressor along the drive shaft. The shaft seal also needs to be lubricated.

The bearings and the shaft seal are lubricated by a portion of the aforesaid lubricating oil-entraining refrigerant carrier which is introduced from a low pressure chamber in consideration of the cooling efficiency and the sealing properties. Since the low pressure chamber is normally disposed on a front-side-block side of the compressor, the bearing and the shaft seal disposed on this side are directly lublicated by the refrigerant carrier supplied from the low pressure chamber at a low pressure. The low pressure chamber is however not always disposed on the front-side-block side but sometimes disposed on the opposite side, i.e. the rear-side-block side so as to conform to a mode of application of the compressor.

In such compressor having a low pressure chamber on its rear-side-block side, a guide hole is formed longitudinally in a rotor drive shaft to intercommunicate the low pressure chamber on the rear-side-block side and a bearing and a shaft seal disposed on a front-side-block side, thereby supplying the refrigerant carrier to the bearing on the front-side-block side.

The compressor having such guide hole is still disadvantageous in that since the bearing and the shaft seal on the front-side-block side are held in air tight, a pressure difference produced in the guide hole is insufficient to cause the refrigerant carrier to flow through the gudie hole to the bearing and the shaft seal, thereby lubricating the latter.

With this insufficient lubricating, the bearing is likely to cause a seizing or undue abrasive wear due to commulative frictional heat.

SUMMARY OF THE INVENTION

With the foregoing difficulties in view, it is accordingly an object of the present invention to provide a sliding-vane rotary compressor incorporating structural features which produce a pressure difference large enougth to cause a low temperature and low pressure refrigerant carrier entraining a lubricating oil to flow to a bearing and a shaft seal.

To achieve the foregoing object, there is provided according to the present invention a sliding-vane rotary compressor comprising:

a rotor carrying thereon a plurality of radially movable vanes and rotatably disposed in a space defined jointly by a cylinder and a pair of side blocks attached to opposite ends of said cylinder;

said rotor, said cylinder, said side blocks and said vanes jointly defining therebetween a plurality of compression chambers varying in volume with each revolution of said rotor;

a pair of heads attached to said side blocks, respectively;

one of said side blocks having an intake hole, one of said heads which is attached to said one side block having a low pressure chamber, said intake hole communicating said compression chambers with said low pressure chamber;

said cylinder having a discharge hole, the other head having a high pressure chamber, said discharge hole communicating said compression chambers with said high pressure chamber;

first fluid-communication means having opposite ends, one end of which opens to said compression chambers at a position upstream of said intake hole as viewed in the direction of rotation of said rotor, the other end of said fluid-communication means opening to a bearing/shaft-seal chamber defined jointly by a bearing on which a drive shaft secured concentrically to said rotor is supported, and a shaft seal sealingly fitted over said drive shaft; and second fluid-communication means for communicating said low pressure chamber with said bearing/-shaft-seal chamber.

With this construction, when the rotor is rotated, the vanes move across the suction chamber. During that time the corresponding one of the compression chambers increases in volume, thereby producing a negative pressure which causes a portion of the refrigerant carrier to be drawn into the suction hole. Consequently, there is produced a pressure difference between the bearing/shaft-seal chamber and the low pressure chamber, which pressure difference causes the portion of the refrigerant carrier to be drawn into the bearing/shaft-seal chamber, thereby sufficiently lubricating the bearing and the shaft seal by a lubricating oil entrained in the refrigerant carrier.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A certain preferred embodiment of the present invention will be described hereinbelow in detail with reference to the accompanying drawings.

Figure 1:
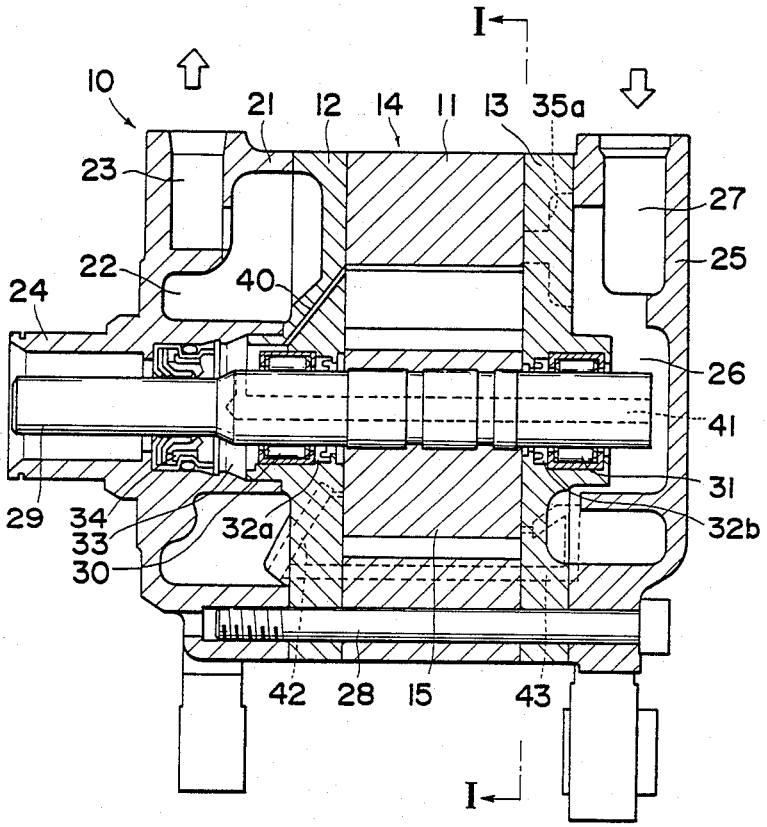
FIG. 1 is a longitudinal cross-sectional view of a sliding-vane rotary compressor according to the present invention.
Figure 2:
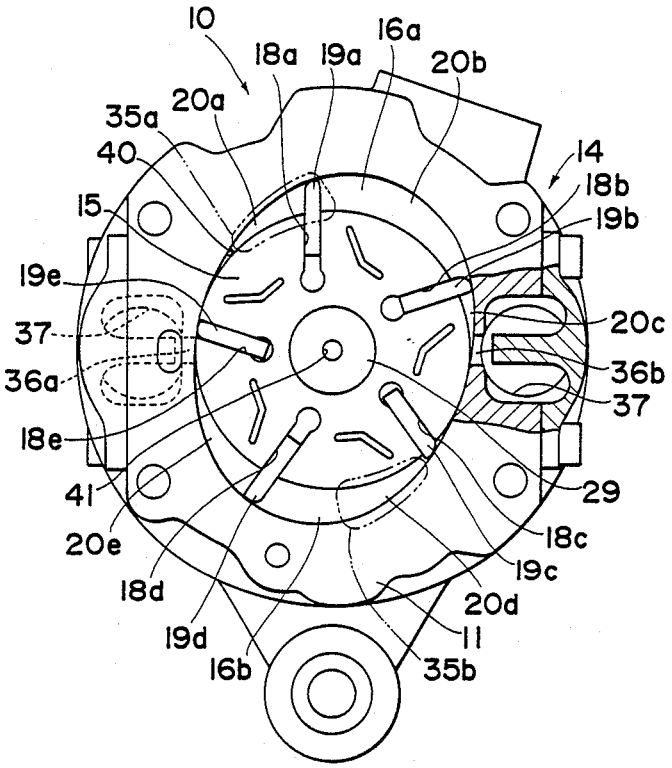
FIG. 2 is a cross-sectional view taken along line I—I of FIG. 1.

FIGS. 1 and 2 show a sliding-vane rotary compressor 10 embodying the present invention. The compressor 10 includes a cylinder 11 having a substantially elliptical bore, and front and rear side blocks 12, 13 firmly connected to opposite ends of the cylinder 11 to close the cylinder 11. The cylinder 11 and the front and rear side blocks 12, 13 jointly constitute a compressor body 14 in which a circular rotor 15 is disposed. The rotor 15 is rotatably received in the elliptical bore in the cylinder 11 with two diametrically opposite clearances defined therebetween along a minor axis of the elliptical cylinder bore so that there are two operating compartments 16*a*, 16*b* defined within the compressor body 14 in diametrically opposite symmetric relation to one another. The rotor 15 includes a plurality (five in the illustrated embodiment) of approximately radial slots 18*a*–18*e* in which vanes 19*a*–19*e* are slidably inserted, respectively. With this arrangement, there are defined between the cylinder 11, the front and rear side blocks 12, 13, the rotor 15 and the individual vanes 19*a*–19*e* a total of five compression chambers 20*a*–20*e*.

A front head 21 is firmly connected to the front side block 12 so as to define therebetween a high pressure chamber 22. The high pressure chamber 22 is communicated with a discharge port 23 difined in the front head 21. The front head 21 includes a central hollow cylindrical hub 24 for receiving therein a clutch device for transmitting a driving power from a driving means to a drive shaft 29 described later on.

A rear head 25 is firmly connected to the rear side block 13 so as to define therebetween a low pressure chamber 26. The low pressure chamber 26 is communicated with an intake port 27 defined in the rear head 25.

The front head 21, the front side block 12, the cylinder 11, the rear side block 13 and the rear head 25 are joined together by means of a plurality of stud bolts 28 (only one shown in FIG. 1).

The drive shaft 29 is firmly fitted in a central hole in the rotor 15 and is rotatably supported by a pair of bearings 30, 31 mounted, respectively, in the front and rear side blocks 12, 13.

As shown in FIG. 1, the right side (inner side) of the bearing 30 is sealed by a seal 32*a* mounted on the drive shaft 29 while the left side (outer side) of the bearing 30 faces a bearing/shaft-seal chamber 33, the left side of which is defined by a shaft seal 34 sealingly fitted over the drive shaft 29. The left side (inner side) of the bearing 31 is sealed by a seal 32*b* mounted on the drive shaft 29 while the right side (outer side) of the bearing 31 faces the low pressure chamber 26. Thus the bearing 31 is lubricated by a refrigerant carrier stored in the low pressure chamber 26.

As shown in FIG. 2, a pair of intake holes 35*a*, 35*b* is defined in the rear side block 13 in diametrically opposite symmetric relation to one another. One end of each of the intake holes 35*a*, 35*b* opens to the low pressure chamber 26. The opposite end of each intake hole 35*a*, 35*b* opens to one of the compression chambers 20*a*–20*e* and extends arcuately over a first half of the compression chamber 20*a*–20*e* as viewed from in direction of rotation of the rotor 15. The cylinder 11 has a pair of diametrically opposite discharge holes 36*a*, 36*b* opening at their one ends to the corresponding ones of the compression chambers 20*a*–20*e*, the opposite ends of the discharge holes 36*a*, 36*b* being communicated with the high pressure chamber 22 respectively througha pair of discharge valves 37.

With this construction, when the rotor 15 is rotated, the compression chambers 20*a*–20*e* progressively increase and decrease in volume to first withdraw the refrigerant carrier from the low pressure chamber 26 through the intake holes 35*a*, 35*b* into the corresponding ones of the compression chambers 20*a*–20*e*, then gradually compress the refrigerant carrier trapped in the compression chambers 20*a*–20*e*, and finally discharge the compressed refrigerant carrier from the compression chambers 20*a*–20*e* through the discharge holes 36*a*, 36*b* to the high pressure chamber 22.

A suction hole 40 is formed by drilling in the front side block 12 and opens at one of its opposite ends to the compression chambers 20*a*–20*e* at a position upstream of the intake hole 35*a* as viewed in the direction of rotation of the rotor 15. The other end of the suction hole 40 is connected with the bearing/shaft-seal chamber 33 defined between the bearing and the shaft seal 34.

The drive shaft 29 has an internal longitudinal guide hole 41 connected at one of its opposite ends to the bearing/shaft-seal chamber 33 and at the other end to the low pressure chamber 26, thereby holding the low pressure chamber 26 and the bearing/shaft-seal chamber 33 in fluid-communication with each other.

Designated by 42, 43 are fluid passages for supplying therethrough the lubricating oil to contacting surfaces between the rotor 15 and the front side block 12 and also between the rotor 15 and the rear side block 13.

With the compressor of the foregoing construction, when the rotor 15 is rotated, the vanes 19*a*–19*e* slide along the inner peripheral surface of the cylinder 11 whereupon the compression chambers 20*a*–20*e* vary in volume with each revolution of the rotor 15.

While the individual vanes 19*a*–19*e* are being disposed in a position between the minor axis of the elliptical bore of the cylinder 11 and the enlarged forward ends of the intake holes 35*a*, 35*b*, the compression chambers 20*a*–20*e* increase in volume, thereby producing a negative pressure which causes the refrigerant carrier to be withdrawn from the intake holes 35*a*, 35*b* into the corresponding ones of the compression chambers 20*a*–20*e*. As the vanes 19*a*–19*e* further advance, the compression chambers 20*a*–20*e* decrease in volume to thereby gradually compress the refrigerant carrier trapped therein. When the leading ones of the adjacent vanes 19*a*–19*e* move past the respective discharge holes 36*a*, 36*b*, the compressed refrigerant carrier is discharged from the discharge holes 36*a*, 36*b* into the high pressure chamber 22 from which the refrigerant carrier is separated from the lubricating oil entrained therein and then discharged from the discharge port 23.

Figure 3:
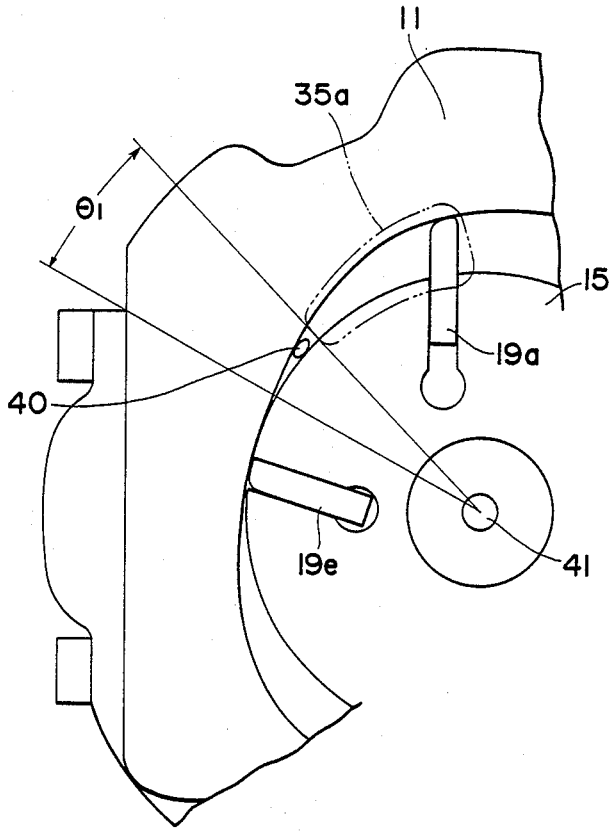
FIG. 3 is an enlarged view showing a portion of FIG. 2.

The negative pressure produced during the suction stroke of the compressor acts exclusively on the suction hole 40 when the vanes 19*a*–19*e* moves through an angle $\theta$ as shown in FIG. 3 with the result that the refrigerant carrier is caused to flow from the low pressure chamber 26 through the guide hole 41 into the bearing/shaft-seal chamber 33 and then drawn therefrom through the suction hole 40 into the compression chambers 20*a*–20*e*. The suction effect still continues after the vanes 19*a*–19*e* is advanced beyond the angle $\theta$. The foregoing suction flow of the refrigerant carrier takes place repeatedly so that a sufficient amount of refrigerant carrier is supplied from the low pressure side to the bearing 30 and the shaft seal 34 on the high pressure side. The refrigerant carrier thus supplied is the same as the refrigerant carrier which is withdrawn from the intake holes 35*a*, 35*b* and hence the supply of refrigerant carrier never causes a power loss or a fluctuation of discharge amount of the refrigerant carrier.

In the illustrated embodiment, the bearing/shaft-seal chamber 33 and the low pressure chamber 26 are connected together by the guide hole 41 formed in the drive shaft 29. The present invention is not limited to the disclosed embodiment. It is possible according to the present invention to provide a guide hole extending successively through the front side block, the cylinder and the rear side block to thereby interconnect the bearing/shaft-seal chamber 33 and the low pressure chamber 26.

The suction hole 40 which is provided on this side of the intake hole 35*a* as viewed in the direction of rotation of the rotor 15 may be provided on this side of the intake hole 35*b* as viewed in the direction of rotation of the rotor 15.

Obviously, various modifications and variations of the present invention are possible in the light of the above teaching. It is therefore to be understood that within the scope of the appended claims the invention may be practiced otherwise than as specifically described.

What is claimed is:

1. A sliding-vane rotary compressor comprising:

(a) a rotor carrying thereon a plurality of radially movable vanes and rotatably disposed in a space defined jointly by a cylinder and a pair of side blocks attached to opposite ends of said cylinder;

(b) said rotor, said cylinder, said side blocks and said vanes jointly defining therebetween a plurality of compression chambers varying in volume with each revolution of said rotor;

(c) a pair of heads attached to said side blocks, respectively;

(d) one of said side blocks having an intake hole, one of said heads which is attached to said one side block having a low pressure chamber, said intake hole communicating said compression chambers with said low pressure chamber;

(e) said cylinder having a discharge hole, the other head having a high pressure chamber, said discharge hole communicating said compression chambers with said high pressure chamber;

(f) first fluid-communication means having opposite ends, one end of which opens to said compression chambers at a position upstream of said intake hole as viewed in the direction of rotation of said rotor, the other end of said fluid-communication means opening to a bearing/shaft-seal chamber defined jointly by a bearing on which a drive shaft secured concentrically to said rotor is supported, and a shaft seal sealingly fitted over said drive shaft; and (g) second fluid-communication means for communicating said low pressure chamber with said bearing/shaft-seal chamber.

2. A sliding-vane rotary compressor according to claim 1, said first fluid-communication means comprising a suction hole defined in said other side block.

3. A sliding-vane rotary compressor according to claim 1, said second fluid-communication means comprising a guide hole defined in said drive shaft.

* * * * *